US006722839B2

(12) United States Patent
Bingman

(10) Patent No.: US 6,722,839 B2
(45) Date of Patent: Apr. 20, 2004

(54) REFUSE COLLECTION BODY

(75) Inventor: John W. Bingman, Blanchard, OK (US)

(73) Assignee: Pendpac, Inc., Fairview, OK (US)

( * ) Notice: Subject to any disclaimer, the term of this patent is extended or adjusted under 35 U.S.C. 154(b) by 150 days.

(21) Appl. No.: 09/999,858

(22) Filed: Oct. 23, 2001

(65) Prior Publication Data

US 2003/0077156 A1 Apr. 24, 2003

(51) Int. Cl.[7] ..... B65F 3/04
(52) U.S. Cl. ..... 414/409; 414/517
(58) Field of Search ..... 414/406, 409, 414/492, 525.2, 525.52, 511, 513, 517, 525.4; D12/15; 296/56, 183

(56) References Cited

U.S. PATENT DOCUMENTS

| | | | | | |
|---|---|---|---|---|---|
| 2,389,769 | A | | 11/1945 | Folsom | |
| 2,961,105 | A | | 11/1960 | Shubin | |
| 3,490,631 | A | | 1/1970 | Smith | |
| 3,687,313 | A | | 8/1972 | Smith | |
| 3,757,969 | A | | 9/1973 | Smith | |
| 3,865,260 | A | * | 2/1975 | Wieschel et al. | 414/517 |
| 3,873,149 | A | | 3/1975 | Churchman | |
| 3,955,694 | A | | 5/1976 | Herpich | |
| 4,221,527 | A | | 9/1980 | Morrison | |
| 4,691,959 | A | | 9/1987 | Verner | |
| 4,909,564 | A | | 3/1990 | Pfeifer et al. | |
| 4,941,796 | A | * | 7/1990 | De Filippi | 414/409 |
| RE33,730 | E | | 10/1991 | Smith | |
| 5,391,039 | A | * | 2/1995 | Holtom | 414/408 |
| 5,492,747 | A | | 2/1996 | Kemp et al. | |
| 5,584,642 | A | | 12/1996 | Huntoon | |
| 5,816,766 | A | * | 10/1998 | Clark | 414/517 |
| 5,868,543 | A | | 2/1999 | McNeilus et al. | |
| 6,146,078 | A | | 11/2000 | Hamill et al. | |
| 6,193,295 | B1 | | 2/2001 | Stragier | |
| 6,250,873 | B1 | * | 6/2001 | Stragier | 414/511 |

* cited by examiner

*Primary Examiner*—Eileen D. Lillis
*Assistant Examiner*—Charles A Fox
(74) *Attorney, Agent, or Firm*—James F. Harvey, III

(57) ABSTRACT

The present invention presents novel features for providing a lightweight, structurally rigid collection body comprising a loading assembly for dumping refuse into an elevated hopper; a reception area for refuse dumped into the hopper; a storage area for storage and compaction of refuse; a packer assembly for compression of the refuse within the storage area; a tailgate providing access to the storage area; a latching mechanism for the tailgate; and an actuation system comprised of hydraulic and electrical components for controlling the operation thereof. The collection body is self-contained and sufficiently rigid for mounting on the chassis of a vehicle without major vehicle modifications. Its walls are constructed of an inner wall, an outer wall, an upper frame member and a lower triangular member, forming a light weight, composite sidewall structure which resists bending and buckling. The inner wall may be easily replaced when damaged without replacement of the outer wall.

23 Claims, 9 Drawing Sheets

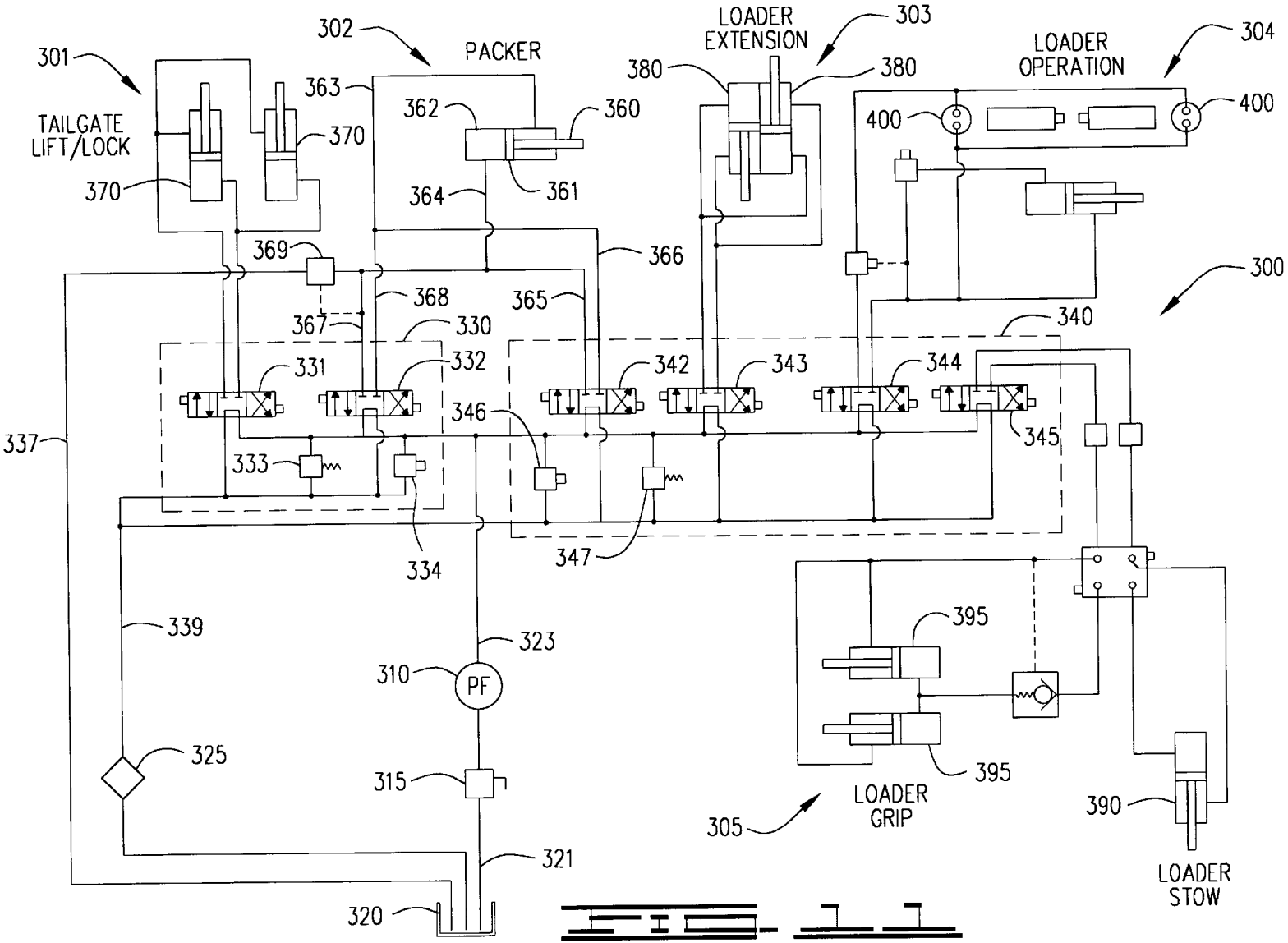
LOADER OPERATION
LOADER EXTENSION
PACKER
TAILGATE LIFT/LOCK
LOADER STOW
LOADER GRIP
PF
300
301
302
303
304
305
310
315
320
321
323
325
330
331
332
333
334
337
339
340
342
343
344
345
346
347
360
361
362
363
364
365
366
367
368
369
370
380
390
395
400

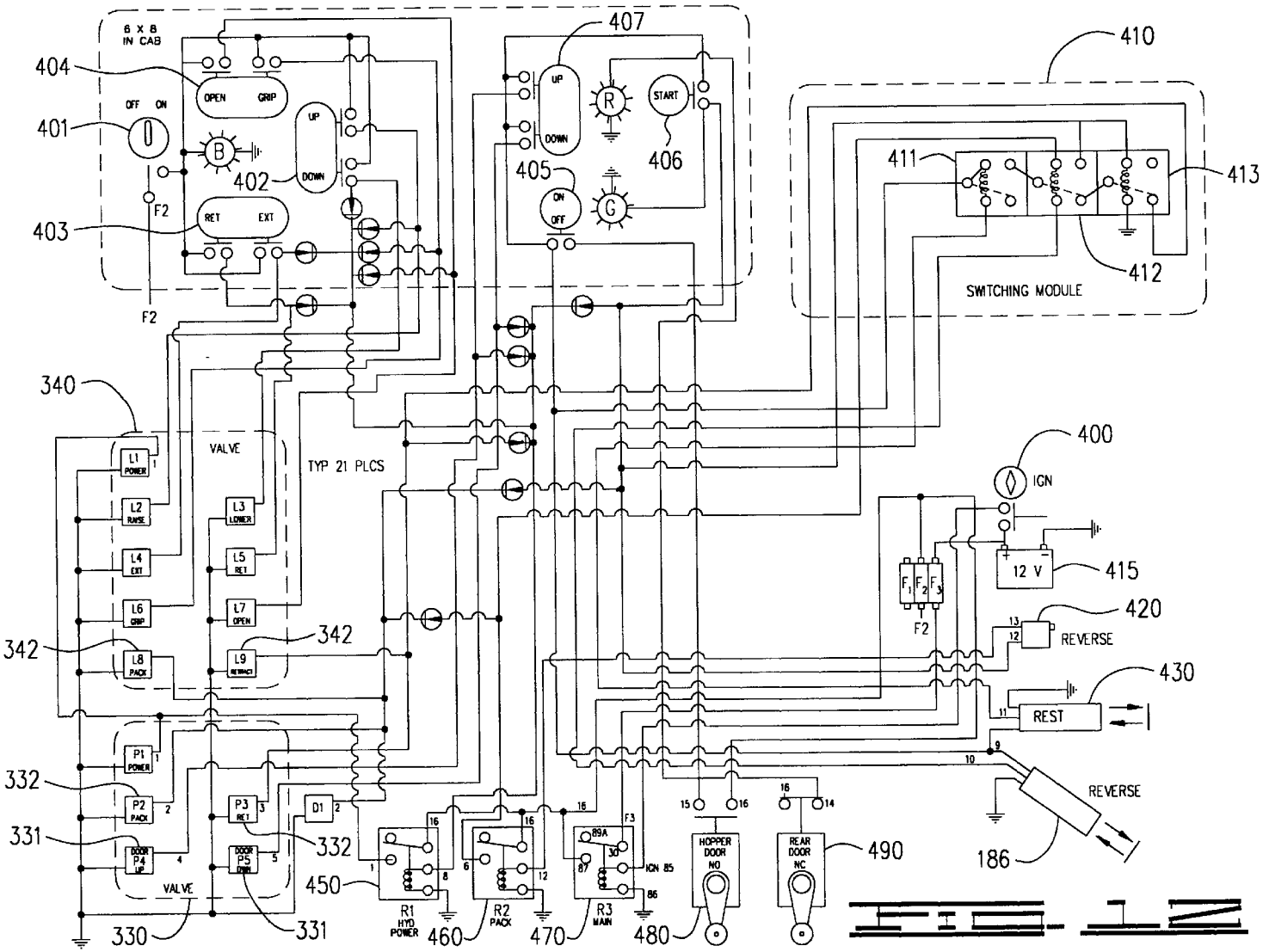
SWITCHING MODULE
IGN
12 V
REVERSE
REST
REVERSE
REAR DOOR NC
HOPPER DOOR NO
START
UP
DOWN
ON
OFF
GRIP
OPEN
EXT
RET
6 X 8 IN CAB
TYP 21 PLCS
VALVE
R3 MAIN
R2 PACK
R1 HYD POWER
410
413
412
411
400
415
420
430
186
490
480
470
460
450
407
406
405
402
404
401
403
340
342
332
331
330

REFUSE COLLECTION BODY

BACKGROUND OF THE INVENTION

1. Field of the Invention

The present invention relates generally to the field of refuse handling apparatus. More particularly, this invention relates to refuse collection bodies of a type having a hopper for receiving refuse and a storage area for storing refuse from the hopper and compressing it to increase storage capacity. In a further and more specific aspect, the present invention concerns novel features for providing a lightweight, structurally rigid collection body comprising a loading assembly for dumping refuse into an elevated hopper; a reception area for refuse dumped into the hopper; a storage area for storage and compaction of refuse; a packer assembly for compression of the refuse within the storage area; a tailgate providing access to the storage area; a latching mechanism for the tailgate; and an actuation system comprised of hydraulic and electrical components for controlling the operation thereof.

2. Description of the Related Art

Modern municipal governments must provide for the collection, removal, and disposal of community refuse. This service, provided either by the municipal government or by contract, consists of requiring the residents to amass their refuse in storage containers for routine collection by refuse collection vehicles. The containers are either provided by the residents or, when standardization is necessary, by the organization providing the service. Residential refuse is generally amassed and stored in containers having a ten to thirty gallon capacity. On a regular basis the containers are placed by the residents for scheduled pick up by the collection service at a designated location, most commonly at the curbside and alley line.

To efficiently perform the collection operation, the service ordinarily uses mechanized and automated refuse collection vehicles supplemented by manual labor. A refuse collection vehicle generally consists of a refuse collection body mounted upon a standard truck chassis, the body having a reception area for the refuse and a storage area where the refuse is stored and generally compacted. The vehicle is attended by a crew of workers that attended to operation of the vehicle and perform loading chores of either manually conveying refuse from collection containers or operating automatic loading devices.

Commonly, the reception area includes a hopper into which refuse is dumped. The hopper may be positioned at a conveniently low loading height so that containers may be manually emptied by workers, or the hopper may be positioned higher on the refuse collection vehicle and accessed by a mechanical loading apparatus which lifts the container and dumps its contents into the hopper. Means are generally provided for transferring the refuse from the hopper to the storage area. The storage area is typically equipped with a packer assembly for compressing loose refuse into a smaller volume so that the carrying capacity of the vehicle is increased. The storage area also typically includes an unloading means for ejecting refuse from the storage area at the disposal site.

Considerable thought has been directed by many in the refuse collection industry towards the development of refuse collection technology. As a result, it is generally agreed that the most efficient method of collecting refuse is for the refuse to be provided at streetside locations in relatively large containers of uniform dimensions which are handled by automated equipment. The containers may, for example, be of sufficient size to service several households. The refuse collection vehicle is equipped with a self-loading device which lifts and dumps the container. Increased load carrying capacity of the vehicle is achieved through the use of compactor-type bodies which compress loose refuse into a smaller area within the storage area. The refuse collection industry has seen numerous designs for accomplishing one or more of these functions, each with its own advantages and disadvantages.

For example, it is well-recognized that a compactor-type body is desirable, but this is accomplished in various ways, usually with reciprocating platen or auger-type packer mechanisms. Loading is accomplished by front, side, or rear mounted mechanisms which may incorporate either fixed or extendible length arms. Refuse may be removed from the collection body either by expulsion by the compactor mechanism or by tilting the body to allow gravity to assist in dumping.

There are a number of particular problems which require better solutions. First, because prior art reciprocating packers are normally perform a packing operation in only one direction, termed the forward stroke, normally defined as being away from the vehicle cab towards the rear end by expansion of a piston, the return stroke constitutes wasted motion and wasted time. Furthermore, dumping of the refuse container into the collection body must be coordinated with the packing action to prevent the accumulation of refuse at the rearward or backside of the platen. While an auger arrangement provides continuous operation, it is at the expense of increased manufacturing costs and decreased reliability. Subjected to unequal forces and having bearings at only one end, the device can be wedged to a stop. In either case, the packing mechanism requires power from the vehicle engine for powering; the load placed on the engine by the packing actuating system precludes the simultaneous performance of the packing operation and transportation of the collection vehicle by the vehicle engine. It is desirable to perform multiple, simultaneous operations for speed and efficiency.

Second, with the increased size of the refuse collection containers, the collection bodies of most refuse collection vehicles have also grown to accommodate larger loads. However, these larger collection bodies have an increased tare weight due to the additional weight required by structural members required to accommodate the weight of the refuse and also by the force exerted against the collection body walls as the refuse is compacted. The walls of the present storage bodies are generally bulky and normally include vertical and/or horizontal bracing elements welded to the walls to rigidify and strengthen the walls or bulky support structures for bracing the storage body. Such walls and structures are expensive to construct, reduce the payload that the vehicle can carry, and diminish the general exterior appearance of the storage body. They further disturb the aerodynamic shape of the refuse collection vehicle which correspondingly decreases the gas mileage of the refuse collection vehicle during normal operation, thus increasing its operating cost. The increased forces necessary for compacting a larger, heavier load of refuse also cause a higher damage rate in the wall structure, necessitating routine replacement; if expensive advertising artwork has been applied to the outer wall, the artwork must be reapplied to a replaced outer wall, thus further increasing expense.

Third, to further enhance the automated collection of refuse, many collection bodies incorporate a tailgate assembly mounted to swing rearwardly and act as a closure for the rearward opening. These tailgate assemblies are normally bulky and incorporate complex mechanical features for latching and unlatching the tailgate assembly with the rearward opening. However, the accessible rearward opening allows refuse collected within the storage container to be ejected from the rearward opening. To this end, apparatus currently exist for either tilting the storage body upwardly to allow gravity to move the refuse from the storage area and outwardly through the rearward end for dumping, or direct ejection of the refuse outwardly through the rearward end. To eject the refuse outwardly through the rearward end of the storage body, innovators have adapted packing mechanisms which operate for not only transferring and packing refuse into the storage area from the reception area, but also for ejecting the refuse outwardly through the rearward end for deposit at suitable waste disposal sites. Although exemplary for intended use, these packing mechanisms are generally bulky, mechanically inefficient, and costly.

Fourth, packing mechanisms can have a number of moving parts involving linkages, rollers, gears, bearings and the like. When refuse of a random nature and high compaction forces are involved, the probability of damage or jamming of the mechanism is high. It would be desirable for a packing assembly to have a low number of moving parts.

Fifth, a collection body usually requires a significant amount of modification to the vehicle chassis in order to integrate the collection body with the vehicle chassis for operation. These modifications may consume significant amounts of manpower to effect or void warranties offered by the vehicle manufacturer. These modifications may also place significant burdens on the engine and drive train of the vehicle so that its performance is impaired; alternatively, they may dictate use of a vehicle which is larger and heavier than necessary or practical. It is desirable to provide a collection body requiring minimal or no modification to the vehicle, other than what is necessary to operationally connect and integrate its components with those of the vehicle.

Sixth, during normal operations, a number of refuse loads are dumped into the hopper before a packing operation is initiated. During movement of the vehicle between pickup locations, air turbulence and high air flow may cause the refuse contained in the hopper to blow out and thus litter the area. It would be desirable to provide a means of attenuating such air movement and prevent such loss of refuse material.

Seventh, it is common practice within the refuse collection technology to use mechanical sensing devices and relays in the sequencing and control of the various components of the collection body. it is thought that mechanical devices have sufficient structural strength to withstand the often harsh environment commonly experienced during ht erefuse collection process. For example, it is common practice to steam clean the interior and exterior of collection bodies to prevent corrosion and buildup of debris; linkages and sensors must be able to withstand these cleaning operations. However, mechanical devices are prone to wear and generally large and heavy. They also require more electrical current to operate. Newer solid state electronics offers devices which are light and inexpensive and require only a low-amperage signal. It would be desirable to replace such mechanical devices with modern, solid state devices for maintainability and weight reduction purposes.

It would be highly advantageous, therefore, to provide a collection body which would solve the foregoing problems in a satisfactory way.

Accordingly, what is needed is an improved refuse collection vehicle which provides the following features: higher payload to tare weight ratio than heretofore; stronger, lightweight sides which can withstand the high compaction forces; installation to a vehicle chassis without modification to the chassis; easy replacement of side walls without defacing or replacing expensive artwork on the exterior surfaces; operation of the compactor during a loading cycle or transportation mode; and improved resistance to refuse loss from wind force during transportation.

SUMMARY OF THE INVENTION

In light of the foregoing discussion, a general object of the present invention is to provide a refuse collection body having improved maintenance and weight characteristics over prior such devices.

Another object of the present invention is to provide a refuse collection body which can be configured to a selected chassis as a unit without major modification or reconfiguration of the vehicle.

Yet another object of the present invention is to provide a refuse collection body with its major operational components located above a lower plane of the collection body so that it can be placed on the upper surface of the chassis as a unit through use of a crane or other lifting arrangement and operationally attached to the chassis through a plurality of attachment means without disturbing the pre-existing vehicle chassis components.

Yet another object of the present invention is to provide a novel tailgate articulation and latching mechanism which prevents undue wear on the gasket between the tailgate and the rear end of the collection body.

Yet another object of the present invention is to provide a refuse collection body having improved, double-walled side structures which are sufficiently strong enough to withstand outwardly directed pressure resulting from packing operations normally occurring in standard refuse handling operations.

Yet another object of the present invention is to provide a refuse collection body with a storage area having an inner wall which can be easily replaced if damaged, without disturbing the outer wall of the storage area.

Yet another object of the present invention is to provide a self-supporting refuse collection body with a storage area having side walls constructed as an elongated, longitudinal beam which supports the collection body components on the vehicle chassis and withstands outwardly-directed buckling forces.

Yet another object of the present invention is to minimize the tendency of air turbulence and high air flow to blown refuse from hopper and reception area.

Yet another object of the present invention is to provide multi-panel cover which partially covers the packer piston, which extends over the vehicle cab when the packer is at rest position, and provides wind protection to the refuse reception area of the collection body to prevent refuse from being blown from the reception area by moving air.

Yet another object of the present invention is to provide a refuse collection body having a system of low amperage, infrared sensors used to control and direct the operation of the packer.

Yet another object of the present invention is to provide a refuse collection body having a hydraulic system which can operate the packer while the vehicle is in transit without overheating the hydraulic pump or hydraulic fluid or lugging down the engine.

Other objects and advantages of the present invention will be set forth in part in the description and in the drawings which follow and, in part, will be obvious from the description or may be learned by practice of the invention.

To achieve the foregoing objects, and in accordance with the purpose of the invention as broadly described herein, the present invention provides refuse collection vehicle consisting of a vehicle with a cab and a chassis and a collection body mounted on the chassis. The collection body is constructed as a unit with all components mounted thereon so that they do not interfere with mounting the collection body to a chassis. The collection body is attached to the chassis at a plurality of attachment points using standard means known to the industry such as bolts, welding, pins, and the like. In this manner, a new collection body may be easily installed on an old vehicle chassis when the collection body is worn out or an old collection body can be installed on a new vehicle chassis. The collection body is self supporting which allows it to be lifted by a crane or like apparatus at a plurality of lifting points without causing undue stress on the body. The hydraulic pump and hydraulic fluid reservoir are designed to be mounted under the vehicle chassis at a convenient position depending upon the particular chassis design.

The collection body is comprised of a reception area adjacent to the vehicle cab for receiving refuse and a storage area adjacent to the reception area for storage and compacting of refuse. Within the collection body is a packer assembly reciprocating from a first position in the proximity of the front wall of the collection body adjacent to the cab to a second position in the proximity of the rear of the collection body, so as to move refuse from the reception area to the storage area and to pack refuse within the storage area. A loader means is side mounted from points on the top side of the collection body for automated loading of refuse from containers placed alongside the road. The loading means may be any of a number of automated loading mechanisms known to the industry which are designed for lateral extension from the collection body from a top mounted guiding mechanism, acquiring loading refuse containers located alongside the vehicle, lifting them from a ground position to a position over the top of the collection body, and dumping the contents of the refuse container into the reception area of the collection body. A tailgate removably covers the rear end of the collection body.

The collection body is constructed as a storage area having a pair of side structures which are in concept self-supporting longitudinal beams. These side structures are constructed using a longitudinal a upper framing member, a lower triangular beam member, a planar inner wall, and a curved outer wall. This novel method of side structure construction permits the inner wall to be replaced when it is damaged during normal operation of the packer assembly within the collection body without interference with the outer curved wall. The outer wall can thus be adorned with expensive artwork for identification, advertisement, and routine damage to the inner wall will not necessitate replacement and redecoration of the outer wall. Further, the curved outer wall is smooth in aspect which promotes ease in steam cleaning and aerodynamic efficiency.

The tailgate is articulated by a novel hydraulic piston arrangement whereby the extension of the tailgate piston first unlatches the tailgate from locking engagement with the collection body and then swings the tailgate upwardly. This swinging movement eliminates any lateral movement of the tailgate along any axis of the collection body to prevent undue wear on any gasket material which may surround the rear opening of the collection body.

The electrical system features low amperage sensors which determine the position of the packer assembly to control its movement. A novel electrical circuit which is believed to be new to the refuse collection art uses ladder logic to sequence the movement of the packer assembly and prevent injury to maintenance personnel. The circuit employs retroflective infrared sensors which are more reliable than mechanical sensors and promote low maintenance cost for the collection body.

The hydraulic system consists of a unique design for directing hydraulic fluid to the packer piston to allow use of the packer while the vehicle is in operation or while other systems such as the loading means are in use. This design involves dividing the hydraulic fluid line supplying hydraulic fluid to the extension side of the packer piston so that it is delivered through a plurality of lower capacity solenoid operated valves instead of one high capacity hydraulic valve. Each of the smaller valves is of a size suitable for less robust hydraulic operation, e.g the tailgate operation or operation of the loading means; but when operated in parallel such as described in the invention, they permit a high flow rate of hydraulic fluid to the packer piston without the associated heat being generated, which in turn results in lower cost components and longer maintenance cycles. This design permits the use of a lower capacity hydraulic pump which can operate at higher revolutions per minute without overheating.

The present invention will now be described with reference to the following drawings, in which like reference numbers denote the same element throughout.

BRIEF DESCRIPTION OF THE DRAWINGS

FIG. 6 shows the articulation means for the tailgate when the tailgate is in a closed position.

FIG. 11 shows a schematic diagram of the hydraulic system used to articulate the various components associated with the collection body.

FIG. 12 gives a schematic diagram of the electrical system used to control the hydraulic system and sensors and its relationship with the electrical system of the vehicle.

DESCRIPTION OF PREFERRED EMBODIMENTS

The directions "front", "back", "left", "right", "top", and "bottom" shall be made with reference to the collection body as it is oriented in a horizontal position with reference made to "front" as being in the direction of the cab of the vehicle and "back" or "rear" as being in a direction away from the cab of the vehicle. Reference to "left" shall be made looking towards the front of the vehicle and shall denote the driver side of the vehicle, whereas reference to "right" shall denote the opposite, or passenger, side of the vehicle. The terms "top" and "bottom" shall have their usual meanings within the foregoing explanation, with "top" denoting the upper surface, or extent, of the vehicle and/or collection body and "bottom" denoting the lower surface, or extent, of the same.

Figure 1:
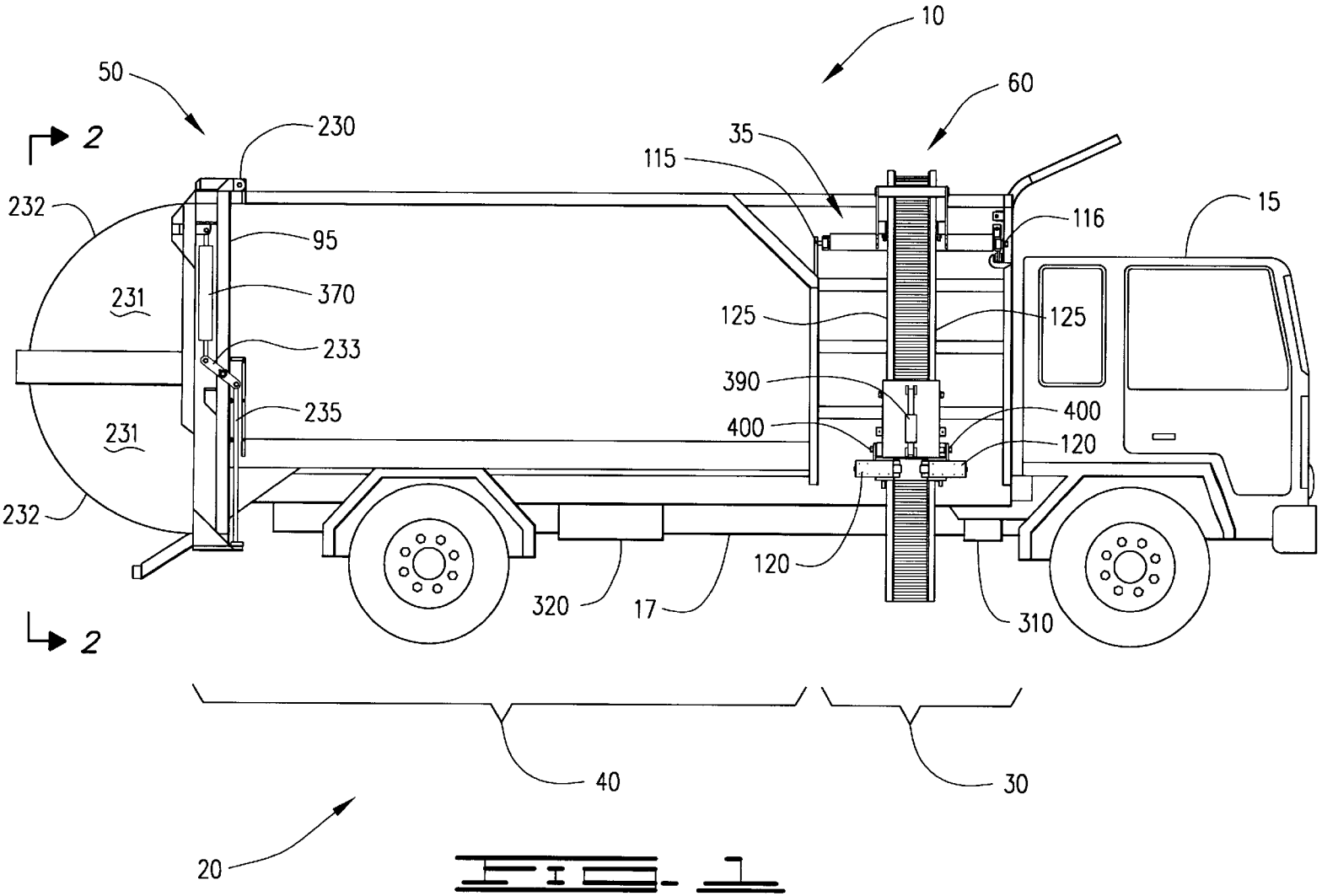
FIG. 1 is a side view of the refuse collection vehicle showing details of the passenger side of the vehicle and the placement of the loading means, the hydraulic fluid reservoir, and the hydraulic pump with relationship to the chassis.
Figure 3:
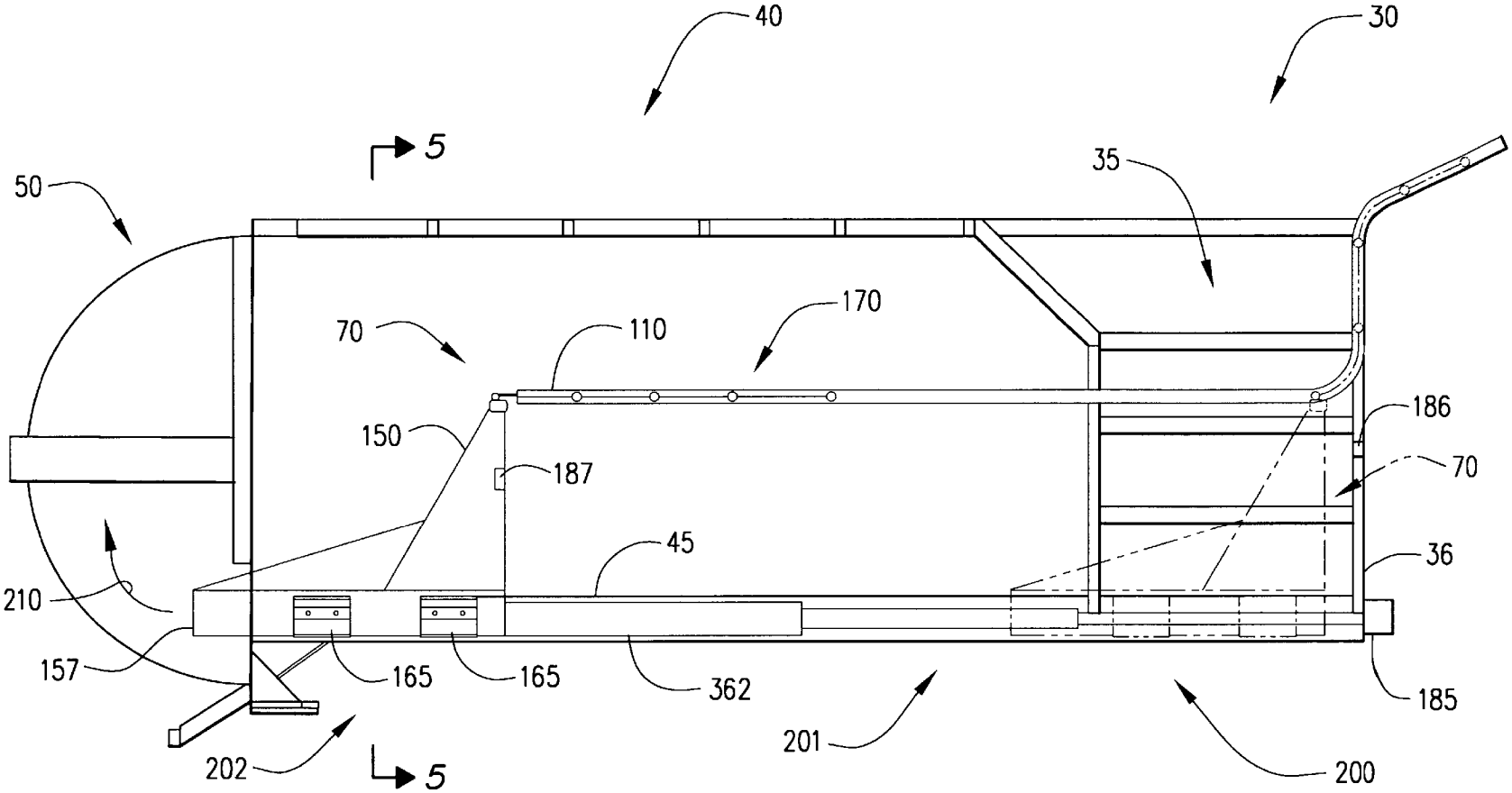
FIG. 3 is a sectional view of the collection body showing the placement of the packer platen and piston with relationship to the floor, the storage area, and the reception area.

Referring now to FIG. 1, the refuse collection vehicle 10 is shown with a collection body 20 mounted thereon. Vehicle 10 has a cab 15 wherein the driver and other workers sit and from which the operation of all components of the refuse collection vehicle is directed. The cab 15 and collection body 20 are mounted on chassis 17 for movement from location to location. Collection body 20 is comprised of a reception area 30, a storage area 40, a tailgate 50, loading assembly 60, and a packer assembly 70 (as shown in FIG. 3). A hydraulic system driven by a hydraulic pump 310 supplies the means to actuate the tailgate, packer assembly, and loading assembly. The hydraulic pump 310 and its hydraulic fluid reservoir are mounted to a convenient location on the underside of chassis 17.

As shown in FIG. 1, the side loading assembly is mounted on the right side of the collection body. While the subsequent discussion will describe the reception area 30 for such an orientation of the side loading assembly, it should be understood that nothing in the description precludes the use of the loading assembly on the left side of the collection body. The description can be easily and appropriately modified for such a mounting orientation and still be within the intent of the invention. Furthermore, a front loading assembly which lifts refuse containers residing in front of the vehicle over the cab could also be employed with the invention without departing from its intent by redesigning and changing the bracing of the reception area to be narrower without impacting the functionality of the packer blade; however, such an installation is not described herein.

Figure 4:
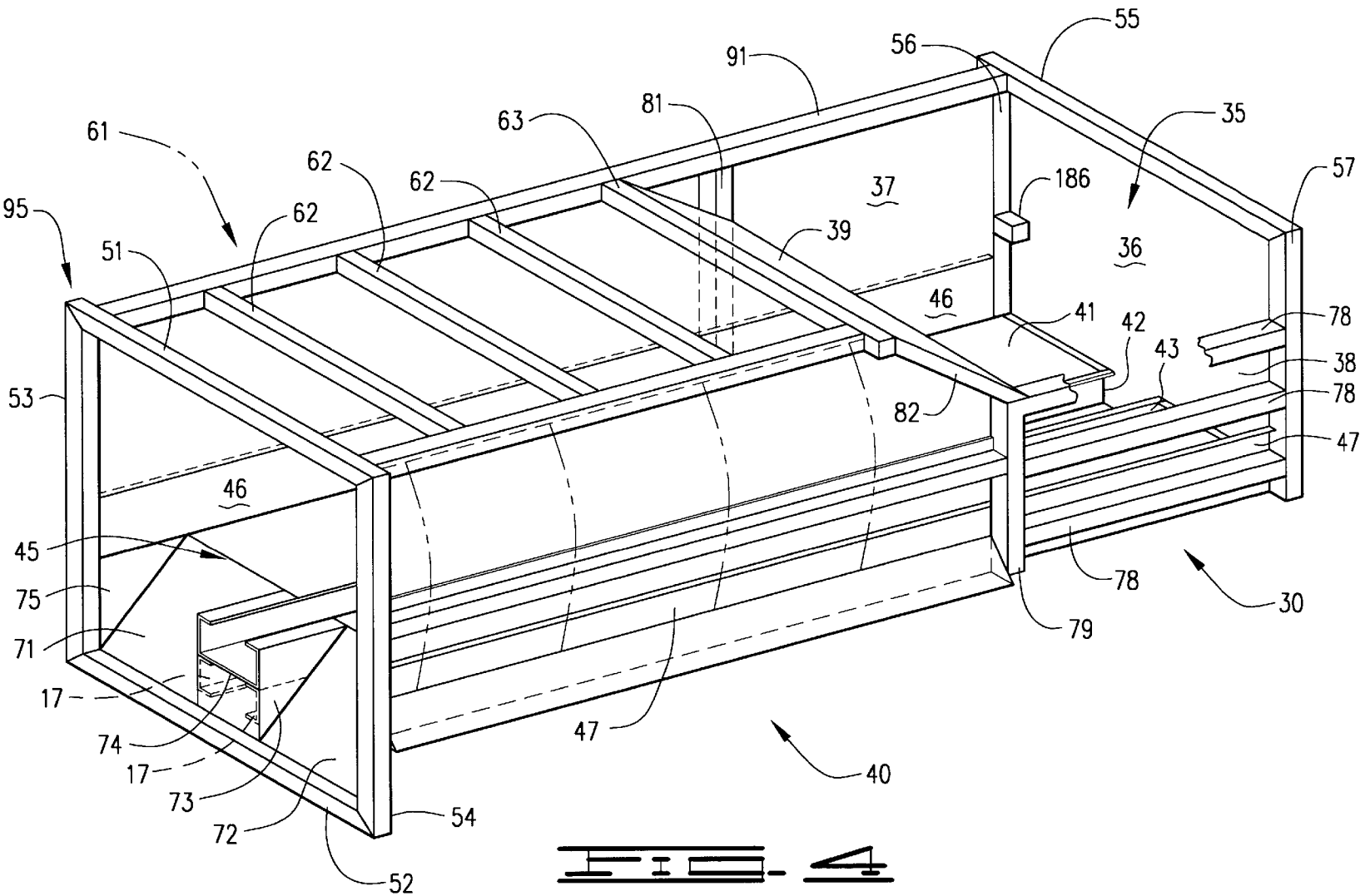
FIG. 4 is a perspective view of the collection body illustrating the construction details of the framing structure.

The collection body 20 is divided into a reception area 30 and a storage area 40. As best seen in FIGS. 1 and 4, the reception area 30 has an open hopper area 35 at its uppermost extent to receive refuse delivered to the hopper area by loading assembly 50. Storage area 40 functions as an area in which refuse is stored, compressed, and transported by the collection body. A framing structure consisting of framing members, side walls, flooring members, and beams encloses the reception and storage areas and will be described presently. It is designed to distribute outward forces generated by the packing function, support the weight of the collection body and the packed refuse, and allow the collection body to be moved as a self-supporting unit for installation on and removal from a vehicle chassis without allowing the weight of the body to deform the body itself.

Figure 5:
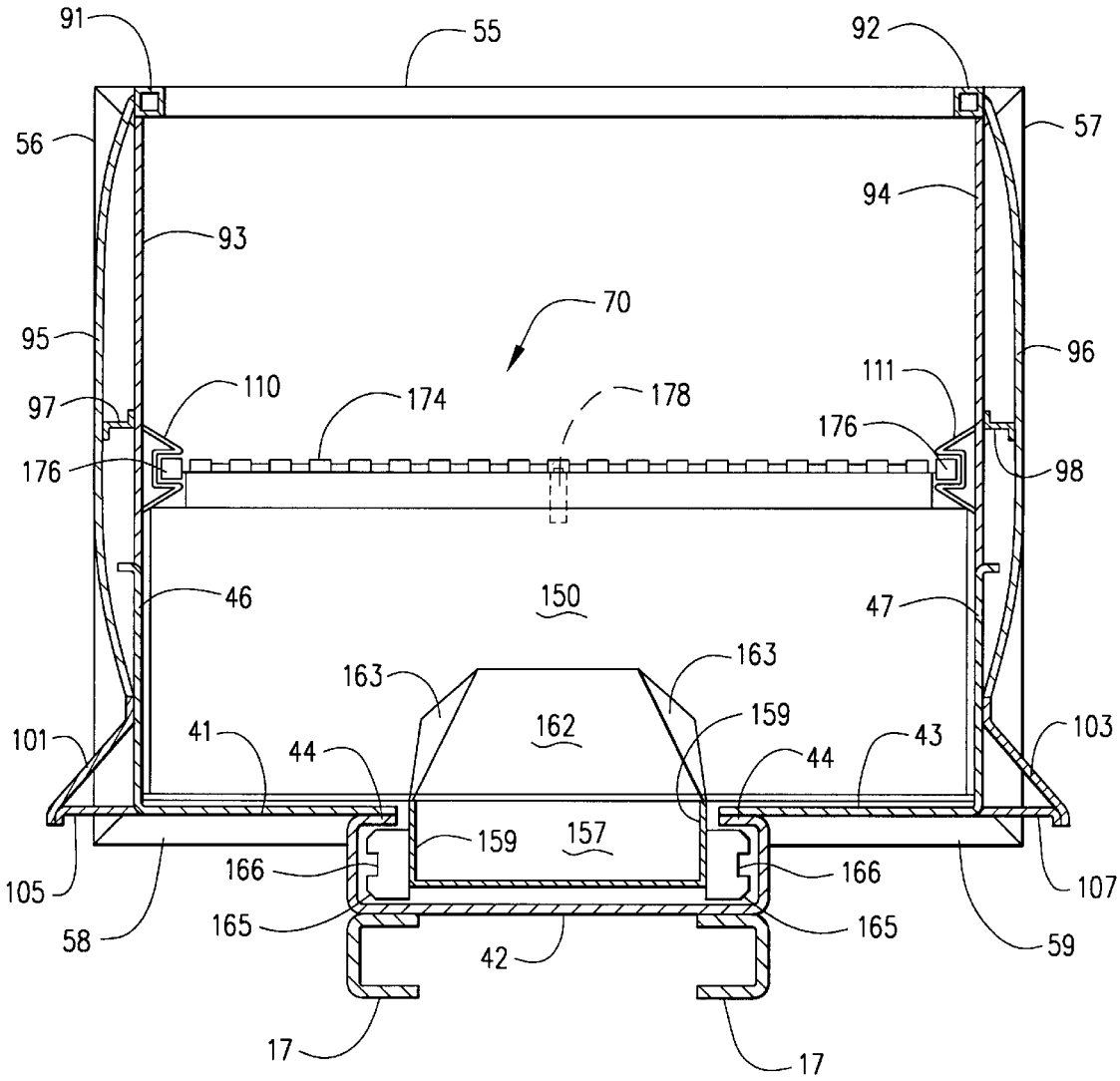
FIG. 5 is a sectional view of the collection body with a view towards the vehicle cab illustrating further construction details of the side structures, the placement of the packer within the packer channel, and the relationship of the collection body to the chassis.
Figure 5:
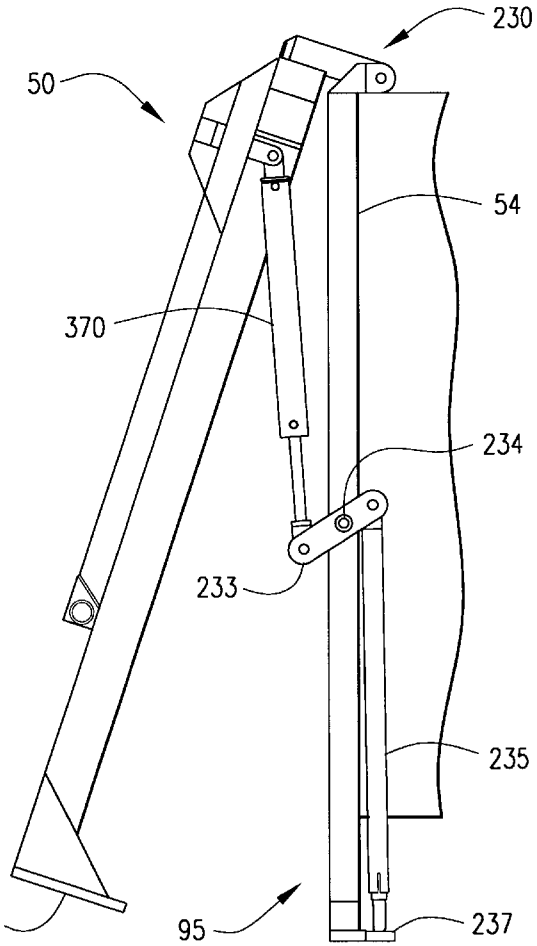

The framing structure is best seen with reference to FIGS. 3, 4, and 5. The rear end of collection body 20 is defined by a generally rectangular assembly of four frame members which serve as a vertical rear frame 95 for the rear end and support the tailgate hinging arrangement and articulation means. As shown, this assembly consists of upper rear frame member 51, lower rear frame member 52, left rear frame member 53, and right rear frame member 54. The frame members are hollow and generally square in cross section. Their ends are preferably mitered and welded where they meet at the corners to prevent intrusion of moisture to cause corrosion. However, without departing from the spirit of the invention, they may also be assembled as flush butt joints with open ends exposed and connected with each other by means commonly employed in the industry, including bolts or welding, and optionally reinforced by gussets or similar braces (not shown). In a similar manner, the front wall 36 is framed on the top and sides by a vertically oriented collection of frame members consisting of upper front frame member 55, left front frame member 56, and right front frame member 57. Left bottom frame member 58 and right bottom frame member 59 are more easily seen in FIG. 5, as they are hidden from view in FIG. 4. The upper front frame member 55 and upper rear frame member 51 are connected by a left longitudinal frame member 91 which extends the entire length of the collection body. A shorter right longitudinal frame member 62 extends from the upper rear frame member 51 towards the front of the vehicle.

The top 61 is supported along its rear edge by upper rear frame member 51 and along its forward edge by primary cross frame member 63 and extends between left longitudinal frame member 91 and right longitudinal frame member 92 to form a generally rectangular extent covering the storage area. It is supported by a plurality of cross frame members 62 between upper rear frame member 51 and primary cross frame member 63, the cross frame members permanently connecting left longitudinal frame member 91 and right longitudinal frame member 92 as by welding, bolts, or other means well known to the art. Alternatively, top 61 may be installed on the undersides of cross frame members 62 leaving them exposed so that the storage area will have a smooth, unbroken interior surface; however, this alternative embodiment has the disadvantage of allowing water to collect within the areas created by cross frame members 62 and top 61 to cause corrosion and possible leakage into the storage area. A sloping panel 39 extends from primary cross frame member 63 downwardly to define the rear extent of the hopper area 35; an imaginary vertical plane positioned at the lower extent of sloping panel 39 defines the rear side of the reception area 30 and front wall 36 defines the opposing side of reception area 30.

Both storage area 40 and reception area 30 share a common floor 45 consisting of a packer channel 42 centered within the collection body, a left floor plate 41 and a right floor plate 43. Floor plates 41, 43 extend from the front wall 36 towards the rear end of collection body 20 and through both reception area 30 and storage area 40. Flanges 44 of packer channel 42 may be welded to the undersides of floor plates 41, 43, or alternatively, the inner edges of floor plates 41, 43 may be welded to the outer edges of the flanges 44 of packer channel 42 to form a planar surface.

The packer channel 42 serves as a main support for the collection body 20 on a vehicle chassis 17 along the length of the collection body.

Left lower side wall 46 extends vertically from the outer edge of floor plate 41 upwardly along the inner surface of left front frame member 56 and left rear frame member 53 to form a portion of the inner wall of both the storage area and reception area. In a similar manner right lower side wall 47 extends vertically from the outer edge of floor plate 43 upwardly along the inner surface of right front frame member 57 and right rear frame member 54. A longitudinal lip is formed along the upper edges of lower side walls 46, 47 for strengthening against bending. Lower side walls 46, 47 are preferably constructed by bending an elongated metal sheet along its longitudinal extent to form a ninety degree angle, with the lower side wall formed therefrom by the vertical portion and the floor plate formed by the horizontal portion, and then removing a generally rectangular portion from the rear end of the floor portion. Optionally, two separate metal sheets, one as the floor plate and one as the side wall, may be welded or bolted in a ninety degree orientation along their longitudinal sides. Floor plates 41, 43 do not extend completely to the rear frame 95, but terminate a short distance therefrom. A left sloping floor plate 71 and right sloping floor plate 72 each slope at roughly a forty-five degree angle from the rear edge of the corresponding floor plates to the bottom rear frame member 52 of rear frame 95, leaving the packer channel 42 to extend horizontally to the plane of the rear frame 95. A triangular left rear wall gusset 75 vertically covers the area between left lower side wall 46, left sloping floor plate 71 and left rear frame member 53. A triangular right rear wall gusset (not shown) vertically covers the corresponding area between right lower side wall 47, right sloping floor plate 72, and right rear frame member 54. A triangular right channel gusset 73 vertically covers the area between the upper flange of the packer channel and the right sloping floor plate 72, and similarly a triangular left channel gusset (not shown) covers the corresponding area on the opposite side of the packer channel. An end plate 74 covers the area between the two channel gussets, the lower edge of the packer channel 42 and bottom rear frame member 52.

Directing attention to the reception area shown in FIG. 4, the reception area 30 is located adjacent to cab 15 and is bounded by front wall 36, left side partition 37, right side partition 38, and an imaginary vertical plane positioned at the lower extent of sloping panel 39, as previously described. Loader horizontal supporting members 78 are inserted between right front frame member 57 and right short frame member 79 to provide support for the side loading assembly. Right sloping frame member 82 connects the upper end of right short frame member 79 with the right end of primary cross frame member 63 to support the right edge of sloping panel 39.

The side wall structure of storage area 40 is shown in FIGS. 4 and 5 and will now be described. The side wall structures comprising the sides of storage area 40 are in the nature of a closed, hollow beam configuration having a planar inner skin and a curved outer skin longitudinally preferably separated by a Z-brace at approximately the mid point of both skins. The inner skins consist of lower side walls 46, 47 and upper side walls 93, 94 aligned in the same plane and welded along their corresponding edges. The upper side walls 93, 94 are preferably constructed of a light gauge metal sheet, and the lower side walls 93, 94 are constructed of a thicker, more sturdy metal sheet since the lower side walls are subjected to higher pressures by the packing operation than the upper side walls. However, the preferable use of two metal sheets to construct an inner skin does not preclude the choice of a single metal sheet for an entire inner skin. The inner skin is supported from above by the longitudinal frame members 91, 92, wherein the upper side walls 93, 94 are welded to the outer surface of longitudinal frame members 91, 92. The lower edges of the inner skin are supported along their length by triangular lower beams constructed of lower supports 105, 107 and an angled supports 101, 103. Lower supports 105, 107 are welded to the bottom edge of corresponding lower side walls 46, 47 in the same horizontal plane as corresponding floor plates 41, 43 to extend outwardly from the collection body slightly beyond the vertical plane of the outer surfaces of frame members 53, 54, 56, and 57. The upper edges of angled supports 101, 103 are welded along their length to corresponding lower inner walls 46, 47 a distance upwardly from their lower edges. Left Z-brace 97 is attached at its ends to the interior facing sides of frame members 53 and 81, and right Z-brace is similarly attached between frame members 54 and 79.

A curved outer skin 95 is attached to the structure thus described by connecting its lower edge to the upper edge of angled support 101 along the length of both, connecting its approximate mid points to Z-brace 97, and connecting its upper edge to the outer surface of longitudinal frame member 91. Such connection is preferably made by welding but can also be accomplished by rivets, bolds, screws, or other appropriate means to rigidly attach the outer skin to the structure. The front and rear edges of outer skin 95 butt up to the facing inner surfaces of frame members 81 and 53 and are connected as by welding to form a closed volume therein. In similar manner, outer skin 96 is attached to the structure by connecting its lower edge to the upper edge of angled support 103, connecting its approximate mid line to Z-brace 98, and connecting its upper edge to the outer surface of frame members 92 and 82. Note that the angled nature of frame member 82, a portion of outer skin 96 must be trimmed away for a proper fit.

The composite side structures thus formed of inner and outer skins, frame members, and Z-braces are light weight self-supporting. They have been shown to withstand outwardly directed pressures exerted by packing operations. The use of a such a complex composite beam structure for the side walls of the storage area reduces the weight of the collection body since lighter materials can be used in construction, and the structures require less side bracing than other apparatus of this type since they are by their nature highly resistant to buckling. Since the side structures make the collection body self-supporting, the collection body can be moved as a unit without distortion by its own weight so that it can be easily installed upon a vehicle chassis by means of a crane, lift, or the like. The construction of the side structures is such that the inner skins, either upper or lower side walls or both, can be replaced when they are damaged without the necessity of replacement of the outer skins. This feature allows the application of decorative art work to remain undisturbed during any such repair action.

The use of a Z-brace is preferred as a separation means since it adequately separates the inner and outer skins, can be fabricated without complicated fabrication methods, presents a surface on either side for the attachment of skins, and resists bending. However, it should be understood by those skilled in the art that other methods of fulfilling these requirements may be employed without departing from the scope of the invention. An I-brace could also be used since, like the Z-brace, it presents a surface area on either side suitable for attachment of the skins. Other means of separation are also conceivable. A V-shaped brace could also be used or a series of short, elongated bushings through which a bolt, screw, or rivet is inserted.

Figure 2:
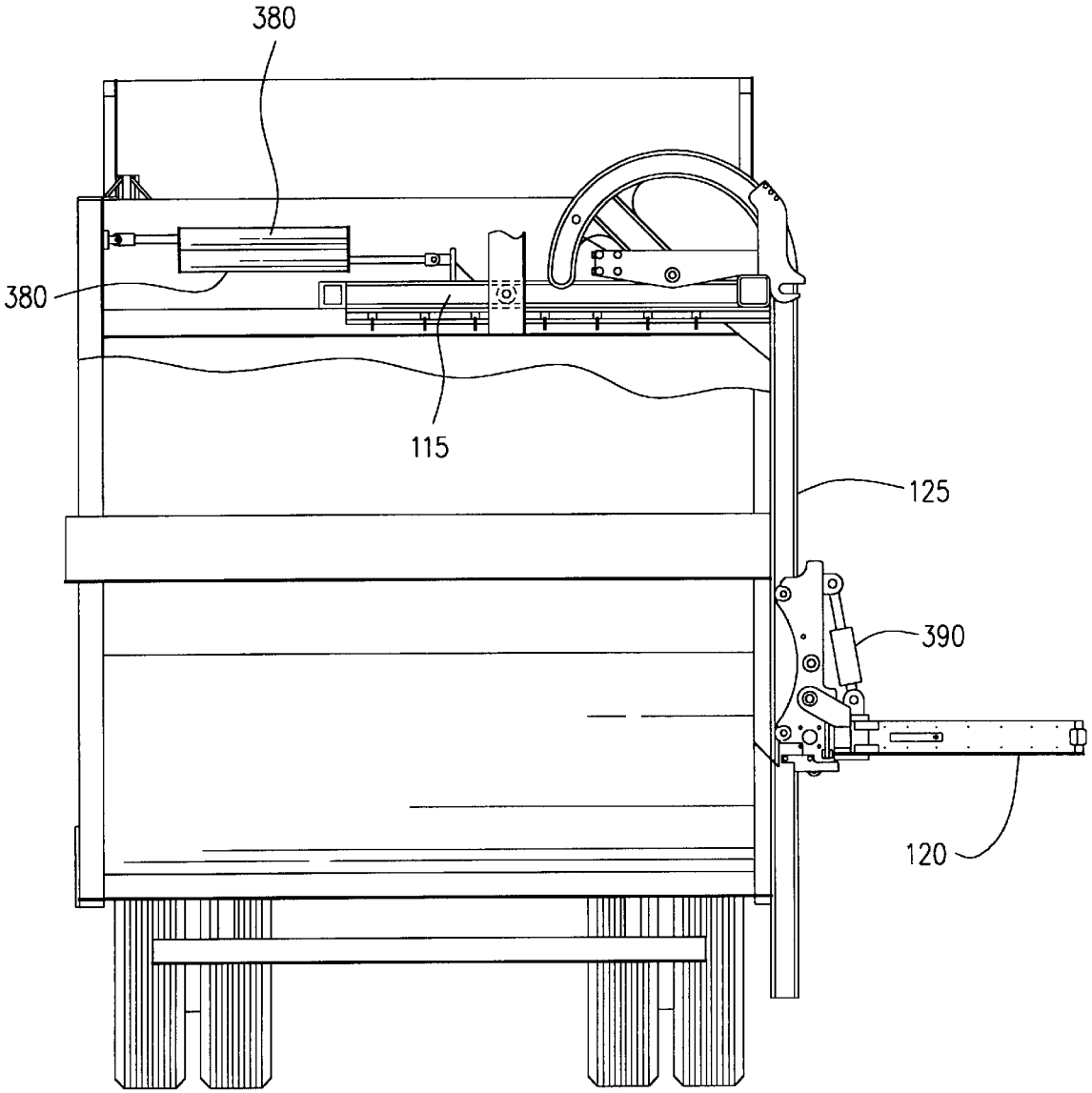
FIG. 2 is a rear view of the refuse collection vehicle showing details of the tailgate covering the rear end of the collection body and the manner in which the gripping arms and the extension means of the loading means are articulated.

The loader assembly 60 shown in FIGS. 1 and 2 is mounted on the right side of the collection body 20. Extension rails 115, 116 support the loader assembly from a mounting arrangement within hopper area 35 with no support structure between the cab and collection body 20 or under the chassis 17. The loader assembly can be laterally extended away from the right side of collection body 20 along extension rails 115, 116 through the expansion of dual hydraulic cylinders 380, in order to position the gripping arms 120, shown in a horizontal orientation, in the proximity of a collection container. The gripping arms are mounted on a carriage 130 which carries the gripping arms with their load up mast 125 to perform a dumping action into hopper area 35. The gripping action is controlled by a hydraulic piston (not shown) for each gripping arm 120. During travel of the vehicle, gripping arms 120 are pivoted into a vertical position by hydraulic cylinder 390. Practice of the invention described herein does not depend upon whether the loading assembly 60 is side mounted for side loading as shown or configured for loading over the cab 15. Although a particular loader assembly is shown in the drawings and generally described so that the invention can be easily understood, it should be recognized that the invention may be used with any suitable hydraulically actuated loading assembly which functions to lift a collection container from ground level and dump it into the elevated hopper area 35 of the invention.

The packer assembly 70 is shown in FIGS. 3, 5, 9, and 10. The packer assembly 70 comprises an angled packer blade 150 supported by a blade support structure 152 which holds the blade 150 in a sloped orientation. The blade 150 and its support structure 152 are mounted to one end of packer carriage 156. The packer carriage 156 is constructed as a rectangular base structure having sides 157, 158, 159, and an open face 160, with the blade 150 and support structure 152 mounted at one end and a sloping deck 162 with sloping sides 163 extending from the central area of the packer blade 150 to cover the other end of packer carriage 156. Two slide bearings 165 are mounted to side 158 and two slide bearings 165 are mounted to opposing side 159, so that each slide bearing 165 extends a slight distance below the carriage 156 for four-point support on a horizontal surface. The slide bearings 165 are attached to their respective sides 158, 159 by a removable attachment means, such as bolts, screws, or any suitable method known to the art, within recessed grooves 166, so that the attachment means not protrude beyond the lateral slide bearing surface. As seen in FIG. 5, sides 158, 159 sized for insertion between flanges 44 of packer channel 42 with slide bearings supporting the packer carriage 156 within the channel for reciprocating movement along its extent.

The slide bearings 165 are preferably composed of a UHMW polyethylene material chosen for its superior wear characteristics and low friction between the slide bearing and the metal comprising packer channel 42. This material allows the packer carriage 156 to skew slightly from the centerline of the packer channel 42 without binding. It is also inexpensive and easily replaced during routine maintenance as it wears. Other materials can be substituted for use in slide bearing composition, and bearing and wheel arrangements can also be substituted for the slide bearings, all without departing from the scope of the invention.

Referring again to FIGS. 9 and 10, a multi-paneled follower 170 is attached to the top edge of the packer blade 150 to extend towards the front of the vehicle in a generally horizontal plane therefrom. It is comprised of a plurality of rectangular panels 172, each constructed of rigid aluminum and connected with one another along their trailing edges by hinges 174 running the width of each panel. In a preferred embodiment, four such panels 172 are used. The rearmost panel 172 is attached to the top of packer blade 150 by a single point pivot 178 which allows the panels to skew slightly with relation to the packer blade 150 without binding. As shown, single point pivot 178 is depicted as a simple bolt inserted through hole in a tab firmly attached to the center of the rearmost panel 172; however, any suitable arrangement permitting the panels to skew slightly in a horizontal plane is acceptable.

The packer assembly 70 and its follower 170 are configured within the collection body 20 to be guided along packer channel 42.The leading edge of each panel 172 supports rollers 176 on each end for rolling engagement with tracks 110, 111, as shown in FIGS. 3 and 5. Tracks 110, 111 are preferably surface mounted to the inner walls of the collection body 20 and extend from the interior thereof out the hopper 35 and partially over the cab 15. The amount of track extending over cab 35 is controlled by the length of follower 170 when packer assembly 70 is positioned at a rest position adjacent to front wall 36. The size of each panel 174 and the number of such panels is preferably chosen so that when the packer assembly 70 has entered the storage area short distance, nominally from one to two feet, the follower 170 will extend from the top of the packer assembly 70 to the front wall 36, thereby providing a covering for the packer channel 42.

The packer assembly 70 and follower 170 are made to move as a unit by means of a hydraulic piston 362, a preferred embodiment being a single four stage telescopic piston. Hydraulic piston 362 is positioned within packer channel 42 below the plane of floor 45, with one end extending under packer carriage 156 and attached to the interior surface of side 157 and the opposing end attached to a piston anchoring means 185 just beyond front wall 36.

In operation, the packer assembly 70 is made to move between three identifiable positions, as indicated by numbers 200, 201, and 202 in FIG. 3. In its first position 200, or rest position, packer assembly is positioned adjacent to front wall 36 with follower 170 extending from the top of packer assembly 70, up front wall 36, and over the top of the cab 15. Upon initially applying power to the electrical/hydraulic system, to be discussed later, the packer assembly 70 will automatically be brought to position 200 by operation of hydraulic piston 362. In position 200, refuse can be dumped into reception area 30 so that it will fall rearward of the packer blade 150. As the level of refuse in reception area 30 gradually rises, the uppermost refuse pieces may be disturbed by wind turbulence as the vehicle moves from location to location. It has been found that when packer assembly 70 is in position 200, the follower 170 which is thus extending over the cab provides a shield against the wind to prevent refuse from being blown from the hopper area 35.

As refuse is collected in reception area 30, it must be moved into the storage area 40 to clear the reception area 30 for receipt of more refuse. This is accomplished by moving packer assembly 70 from position 200 to position 201, or the sweep position. In the sweep position 201, the packer assembly moves all the refuse in the reception area 30 into storage area 40 without packing the refuse. The follower 170 moves from a position over the cab 15 to a horizontal position over the packer channel 42 and extending from the packer assembly 70 to the front wall 36. It can thus be seen that refuse can be dumped into hopper 35 at any time while the packer assembly 70 is moving between its rest and sweep positions 200, 201 with refuse being prevented by the follower 170 from falling into the packer channel 42 between the packer blade 150 and front wall 36.

As refuse accumulates in storage area 40, it must be packed to decrease its volume and thus allow more refuse to be moved therein. By moving the packer assembly 70 to the pack position 202, refuse in the storage area is compressed by packer blade 150 against tailgate 50. While packer assembly 70 is in position 202, the portion of the packer channel 42 within reception area 30 is exposed and therefore refuse cannot be dumped into hopper 35 during packing operations. Packer blade 150 compresses refuse against tailgate 50 which is concave in aspect. As refuse is compressed, it becomes more compact and the pressure which must be applied by packer assembly 70 for packing increases. When pressure on the compressed refuse column increases beyond a certain point, the column is directed upwardly by the curvature of tailgate 50 over the plane of the top of packer blade 150. Follower 170 prevents the packed column thus upwardly directed from spilling over into the portion of the packer channel 42 forward of packer assembly 156. It should be noted that any refuse that accumulates in packer channel 42 in the storage area 40 to the rear of packer assembly 70 is pushed therefrom by the leading side 157 of the packer carriage 156. The packed channel column of refuse eventually encounters tailgate 50 which curves the packed channel column up in the direction 210 and out of the path of the packer carriage 156, thus preventing packer carriage 156 from stalling prematurely.

The position of the packer assembly 70 is made known to the electrical system by means of a retroflective infrared sensor means 186 mounted on one of the vertical framing members adjacent to front wall 36. A reflective means 187 is positioned on the front side of blade support structure 152. The infrared sensor means 186 is an electrical device well known in the electrical art which will send out an infrared signal and sense the same signal when reflected. It is highly resistant to interference from other light sources, has no moving parts, and has an operational life which exceeds mechanical detection means commonly used in the refuse collection art. Infrared sensor means 186 is adjusted to sense a reflected signal from the reflective means 187 when the packer assembly is located in position 201. The precise positioning of infrared sensor means 186 and reflective means 187 is not significant to the invention, as long as it performs the required function without interference from refuse being dumped into hopper 35. It is believed that the use of an retroflective infrared sensor in this manner is a new and novel use within the refuse collection art.

The tailgate 50 (FIG. 1) covers the rear end of collection body 20 and can be pivotally raised to uncover the rear end to allow refuse contained therein to be ejected. Its rectangular shape fits snugly against rear frame 95. Sealing between tailgate 50 and rear frame 95 is accomplished by use of a heavy duty sealing gasket (not shown) of standard composition. Tailgate 50 has a curved rear panel 232 which assists in the compaction of refuse within storage area 40. As discussed previously, the curvature of tailgate 50 directs the packed refuse column upwards and away from the packer blade to prevent premature stalling. The planar sides 231 of tailgate 50 are generally parallel with the inner skins of the storage area. A reinforced hinge assembly 230 located along the top rear frame member 51 allows tailgate 50 to swing upwardly when urged into motion by hydraulic pistons 370 on either side of rear frame 95.

Figure 7:
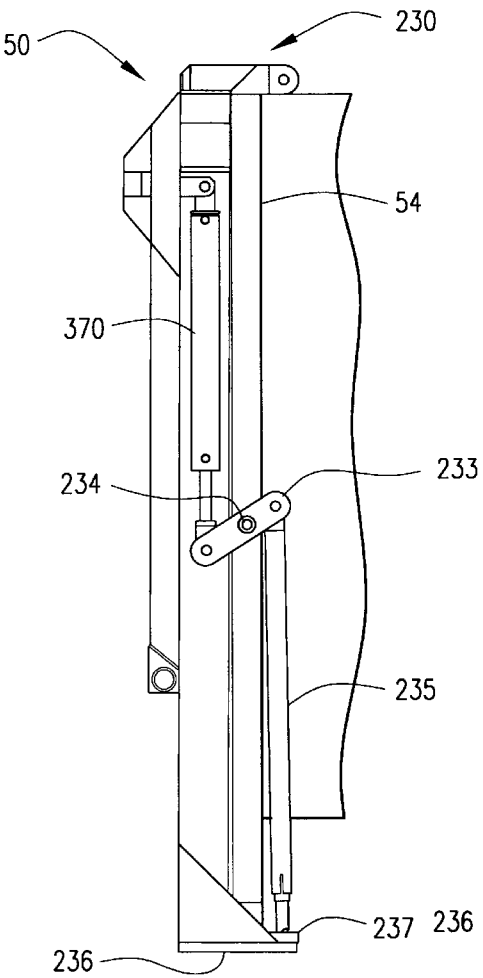
FIG. 7 shows the articulation means for the tailgate when it has been partially activated so as to release the locking mechanism.
Figure 8:
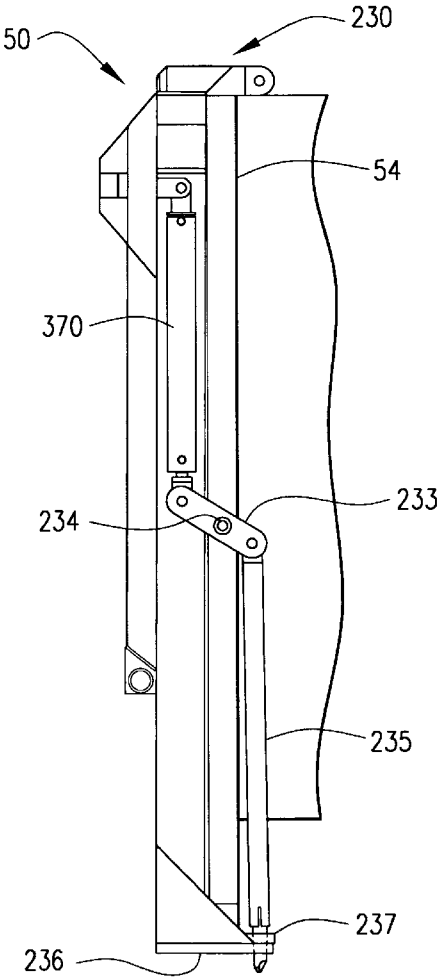
FIG. 8 shows the articulation means for the tailgate when it has release the locking mechanism and begun to raise the tailgate.
Figure 9:
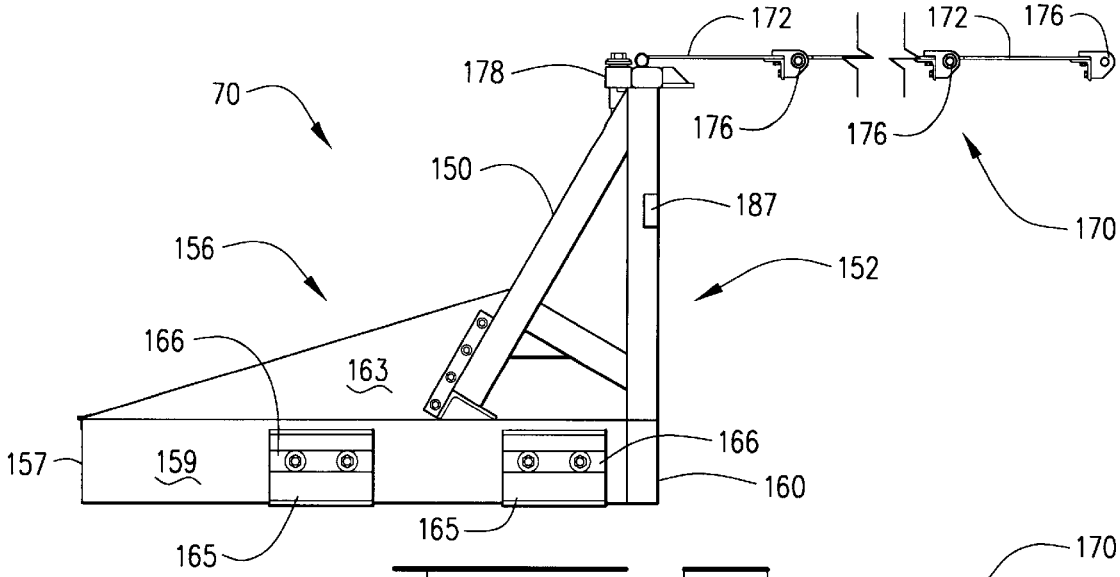
FIG. 9 shows a side view of the packer assembly and the associated multi-paneled cover.
Figure 10:
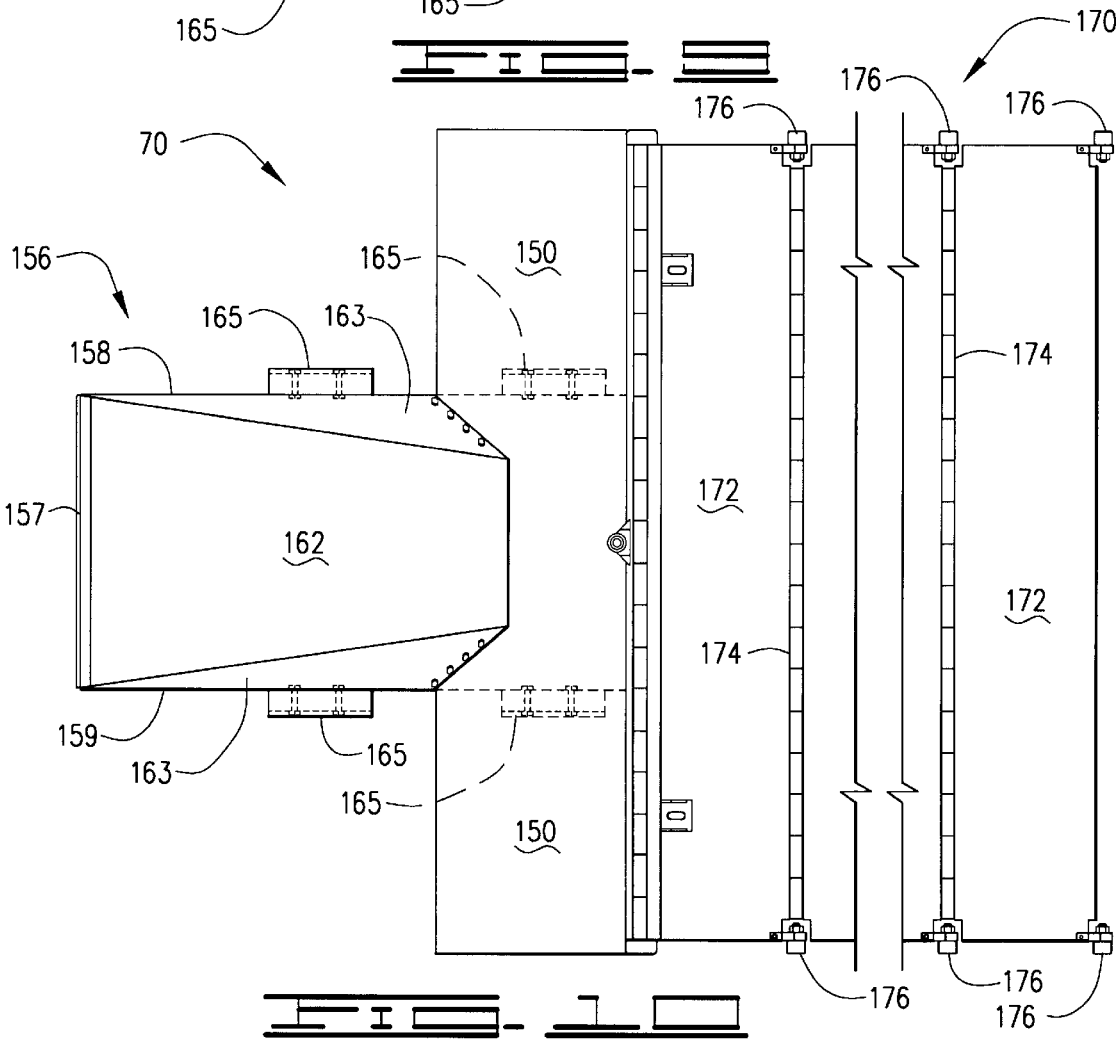
FIG. 10 shows a top view of the packer assembly and the associated multi-paneled cover.

The description and operation of means for latching and articulating the tailgate is shown in more detail in FIGS. 6, 7, and 8. The right side of collection body 20 is illustrated, but the discussion below applies equally to the left side. FIG. 6 represents tailgate 50 in a closed and latched position. Latching is accomplished by latching pin 235 being inserted through aligned holes (not shown) in tailgate latching plate 236 and frame latching plate 237. The free end of latching pin 235 is connected to one end of linkage 233 which controls its movement. Tailgate piston 370 is connected to the other end of linkage 233. When tailgate piston 370 is unexpanded, linkage 233 is held in the indicated locked position which prevents upward movement of pin 235 out of said holes. Linkage 233 is designed to pivot about axis 234 and is constrained by its construction to rotate between the positions shown in FIGS. 6 and 7. Referring now to FIG. 7, when tailgate piston 370 expands, it moves one end of linkage 233 downwardly in a counterclockwise direction which causes the end of linkage 234 connected to latching pin 235 to move upwardly to pull latching pin 235 from the aligned holes. The rotational constraint on linkage 233 is such that latching pin 235 is pulled from the lower hole in tailgate latching plate 236, but it remains within the upper hole in frame latching plate 237 for positioning and alignment purposes. Referring now to FIG. 8, further expansion of tailgate piston 370 against the now-constrained linkage 233 results in a translation of force against the tailgate 50 whereby tailgate 50 begins to pivot on its hinges 230 to open the tailgate. Tailgate 50 is unconstrained from swinging movement by the prior removal of latching pin 235 from the hole in tailgate latching plate 236. The closure of tailgate 50 is simply the reverse of the process described above.

Attention is now directed to FIG. 11 and to the specific details of the hydraulic control circuit 300 used in association with the apparatus. The circuit includes the source or reservoir 320 of hydraulic fluid or oil. A main hydraulic fluid supply conduit includes a supply end 321 for drawing fluid from the reservoir and return end 322 for conveying fluid back to the reservoir. Hydraulic fluid is conveyed through the main supply conduit 323 by means of a pump 310. An in line filter 325 is preferably provided near the supply and return ends of the conduit. Additionally, a ball valve 315 is provided in conduit 321 to prevent flow of hydraulic fluid in the event of system failure or for routine maintenance.

In a preferred embodiment, pump 310 is a positive fixed displacement gear pump, indicated in the figure as "PF", having an output of 20 gallons per minute (GPM) at 1200 engine RPM. The pump 310 is powered by standard means known to the industry, such as a hot shift power take off by which pump 310 may be turned on or off at any time. The pump is sized to operate at all engine speeds and with the vehicle in motion either forward or reverse. Reservoir 320 has a minimum capacity of 50 gallons of hydraulic fluid. The hydraulic system is preferably designed to operate efficiently at between 2000 and 2200 PSIG, and more preferably between 2100 and 2200 PSIG.

The hydraulic circuit 300 further includes five branch conduits. The first branch conduit 301 supplies hydraulic fluid pressure to operate the tailgate hydraulic cylinders 370 for opening and closing the tailgate 50 and for latching tailgate 50 to the collection body 20. The second branch conduit 302 supplies hydraulic fluid pressure to packer cylinder 362 for moving the packer assembly 70 along the packer channel 42.

The remaining branch conduits are associated with the loader assembly 60 and are not essential for understanding of the invention. The third branch conduit 303 supplies hydraulic fluid pressure to the dual loader extension cylinders 380 for extending the loader assembly 60 laterally from the collection body. The fourth branch conduit 304 supplies hydraulic fluid pressure to the carriage of the loader for lifting and lowering operations, as well at to a power assistance cylinder located at the top of the loader mast 125 for assisting the dumping action of the carriage. The fifth branch conduit 305 supplies hydraulic fluid pressure to the loader gripping arms 120 for grasping and releasing a curbside container and to the loader stowage cylinder 390 for placement of the gripping arms into a traveling position. These branch circuits operate in a typical manner for such hydraulic systems.

Hydraulic fluid is distributed to these five branch conduits by means of a twospool main valve assembly 330 and four-spool main valve assembly 340. Each valve assembly consists of a plurality of open center solenoid shift valves controlled by a common supply conduit. Hydraulic valve assembly 330 contains two solenoid operated hydraulic valves, with valve 331 controlling the tailgate lift-lock branch conduit 301 and valve 332 controlling the packer conduit 302. Valve assembly 330 includes a bypass valve 334 which diverts hydraulic fluid back to the reservoir when neither valve 331 or 332 is energized; bypass valve 334 must be open in order for hydraulic fluid to be received by valves 331, 332. Additionally, valve assembly 330 includes a relief valve 333 which diverts hydraulic fluid to the reservoir whenever the hydraulic pressure exceeds a given maximum amount.

Hydraulic valve assembly 340 contains four solenoid operated hydraulic valves, with valve 342 cooperatively controlling packer branch conduit 302, valve 343 controlling loader extension branch conduit 303, valve 344 controlling loader operation branch conduit 304, and valve 345 controlling the loader grip/stow branch conduit 305. Valve assembly 340 includes a bypass valve 336 which diverts hydraulic fluid back to the reservoir when none of valves 342, 343, 344, or 345 is energized; bypass valve 346 must be open on order for fluid to be received by valves 342, 343, 344, and 345. Additionally, valve assembly 340 includes a relief valve 347 which diverts hydraulic fluid to the reservoir whenever the hydraulic pressure exceeds a given maximum amount. Note that valves 332, 342 cooperate in the operation of packer conduit 302, as shall be presently seen.

The packer branch conduit 302 and the tailgate lift/lock branch conduit 301 will be described in detail. The packer branch conduit 302 controls the extension and retraction of the telescoping packer rod 360, which is attached to the packer piston 361 within packer cylinder 362. To extend the packer piston 361, hydraulic fluid is pumped from pump 310 through the packer branch conduit 302, divided between valves 332 and 342, and then joined again at conduit 364 to be applied to the packer piston 362. By dividing the hydraulic fluid supply in this manner, back pressure is reduced at high flow rates, which permits the use of smaller capacity valves which are less costly than larger capacity valves. Furthermore, this reduction in back pressure causes less heat to be generated through friction and turbulence. This in turn reduces fuel usage of the engine and reduces component failure rates, resulting in a more efficient, maintenance-free system. To retract packer piston 361, hydraulic fluid flows back through valves 332 and 342 through return line 339. Dump valve 369 is provided to allow for more rapid retraction of the piston, as well as to prevent excessive pressure build-up in conduit 364 under these conditions, by releasing excess hydraulic fluid through return conduit 337 to reservoir 320 without adversely affecting other branch conduits which may be in operation.

The tailgate lift/lock branch conduit 301 is of straightforward and typical design. Tailgate piston 370 is extended by pumping hydraulic fluid through conduit 323 by pump 310 to valve 331. Fluid flows through valve 331 to extend piston 370. To retract the tailgate piston 370, valve 331 is moved to its alternate position to allow fluid to flow through valve 331 and conduit 339 back to reservoir 320.

Turning now to FIG. 12 with reference to FIG. 11 for hydraulic system interaction, the electrical system for the collection body 20 is shown. The vehicle ignition switch 400 allows the electrical system to be activated and permits other subsystems to be activated as needed. Turning on ignition switch 400 activates the solenoid in main relay 470 to close the normally open relay. Closing relay 470 allows power from vehicle battery 415 to be routed through relay 470 to enable a number of other components, namely the loader assembly power switch 401, the main packer relay 460, main hydraulic power relay 450, and the packer power switch 405.

The packing assembly 70 is prepared for operation by turning on the packer power switch 405 which further permits the packer start switch 406 to be activated. In order for packer power switch 405 to function, any maintenance access doors (not depicted in the drawings) to the reception area 30 must be closed, a condition detected by safety switch 480. Only when safety switch 480 is closed and ignition switch 400 is turned on will packer power switch 405 receive power to function. The initial condition for packer operation is that the packer assembly 70 be at a known position, namely the rest position 200 (FIG. 3). A rest position sensor switch 430 is provided which detects when packer assembly 70 is in its rest position, at which position the rest position sensor switch 430 is open; if the packer power switch 405 is turned on and the packer assembly 70 is at rest position, then no initial movement occurs.

Switching module 410 provides logic for retraction of the packer piston when power is applied to the packer system. A three-relay ladder logic sequence is provided by which the first relay 411, normally open, will provide power to the second relay 412 controlling packer piston extension (normally open) and the third relay 413 controlling packer piston retraction (normally closed). The logic is such that either retraction or extension of the packer piston is permitted, but not both.

Relays 411, 412, and 413 are preferably small, circuit board sized physical relay switches, and more preferably solid state devices. Such switches require low amperage for switching states. As such they have a longer operational life than larger mechanical relays and require less power to operate. Relays 411, 412, and 413 are preferably encased in epoxy within an enclosure to protect them from the environment.

If packer assembly 70 is not at rest position, then rest position sensor switch 430 186is closed. When packer power switch 405 is turned on under this condition, a signal is routed through the packer power switch 405 through rest position sensor switch 430 to provide power to relay 411 (normally off) of switching module 410. Additionally the same signal is routed to rest position sensor switch 430, now closed, and on to turn on first relay 411 to allow the signal to pass through relay 412 (inactivated) and on to relay 413. Relay 413 is normally in a closed position to allow retraction of the packer piston and thus pass the signal on perform the following actions: close the hydraulic power main relay 450 (to open hydraulic valves 334 and 347 so that hydraulic fluid can be directed to the other valves in each valve assembly, in this case, valves 342 and 332); activate the solenoid causing valve 342 to move to a position to retract the packer piston; and activate the solenoid causing valve 332 to move to a position to retract the packer piston. The packer piston 362 will retract until the packer assembly 70 moves to its rest position 200 (FIG. 3). This will cause rest position sensor switch 430, now closed, to open and break the circuit, thus causing relay 411 to switch to an open position and stopping further movement of the packer assembly 70.

A sweep operation, in which the packer assembly 70 moves from rest position 200 to sweep position 201, is performed as follows. The operator momentarily presses the packer start switch 406 to initiate a signal to cause several actions. First, the signal is sent to hydraulic power main relay 450, which action provides power to open the solenoids opening hydraulic valves 334 and 347 so that hydraulic fluid can be directed to the other valves in each valve assembly, in this case, valves 342 and 332. Second, a signal is sent to close the main packer relay 460, which action provides power to the solenoids controlling hydraulic valves 332, 342 to move them into position to extend the packer piston. Note pressure switch 420 must be closed, indicating that the piston is not fully extended, in order to the signal to pass to main packer relay 460. The same output of the main packer relay 460 is routed to switch relay 412 to a state indicating that the packer piston is being extended. Third, the signal opens relay 413 to deactivate the retraction logic.

As the packer assembly 70 begins movement away from its rest position, then rest position sensor switch 430 will close and cause power to be applied to relay 411 and latch the circuit, so that the operator can cease pressing packer start switch 406. Movement of packer assembly 70 will continue until infrared sensor 186 detects the packer assembly at position 201, at which point the infrared sensor 186 will close to pass a signal causing relay 412 to open (passing the signal on to relay 413) and also open main packer relay 460. When main packer relay 460 is opened, then the solenoids controlling valves 332, 342 are deactivated. At this point, relays 411, 412, and 413 and rest position sensor switch 430 are in the same state that obtained on initial power up of the packer electrical system. The packer assembly 70 will thus return to its rest position 200 (FIG. 3) in the same manner as described previously.

A novel aspect of the electrical circuit is the manner in which infrared sensor 186 interacts with switching module 410. Normal practice requires the use of an amplifier board for the signal produced by infrared sensor 186. However, in the invention, infrared sensor 186 drives the relays of switching module 410 directly without intervening amplification or conditioning. This is due to the fact that the devices have similar current requirements.

A packing operation, in which the packer assembly 70 moves from rest position 200 to pack position 202, is performed in a similar manner as the sweep operation, except that the operator maintains pressure on packer start switch 406 so that it remains closed during the packing operation. The actions resulting from continuously pressing the packer start switch 406 are the same as those for the sweep operation, except that when the infrared sensor 186 closes to reverse movement of the packer assembly as described previously, its action is overridden by the signal provided by continuous pressing of the packer start switch 406. The packer piston 362 will continue to expend, and as it compresses refuse, hydraulic pressure will build up until pressure switch 420 opens. At this point, relays 411, 412, and 413 are conditioned in a similar manner as during initial start up and the packer assembly will be returned to its rest position 200.

A ejection operation, in which the packer assembly 70 moves from rest position 200 to pack position 202, is performed in a similar manner as the packing operation, except that the tailgate is first opened. The actions resulting from continuously pressing the packer start switch 406 are the same as those for the packing operation, except that hydraulic pressure will build up as packer piston 362 reaches the maximum extent of its stroke which will also cause pressure switch 420 to open. At this point, relays 411, 412, and 413 are conditioned in a similar manner as during initial start up and the packer assembly will be returned to its rest position 200.

Operations for opening and closing the tailgate 50 are straightforward. When tailgate power switch 407 is placed in an UP position, a signal is sent to close the main hydraulic power relay 450, which action provides power to the solenoid opening hydraulic valve 334 so that hydraulic fluid can be directed to the other valves in the valve assembly, in this case, valve 331. The signal is also sent to move the solenoid controlling controlling hydraulic valve 331 to move it into position to extend the tailgate pistons 370. Similarly, when tailgate power switch 407 is placed in a DOWN position, a signal is sent to close the main hydraulic power relay 450, which action provides power to the solenoid opening hydraulic valve 334 so that hydraulic fluid can be directed to the other valves in the valve assembly, in this case, valve 331. The signal is also sent to move the solenoid controlling hydraulic valve 331 to move it into position to retract the tailgate pistons 370.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A refuse collection body adapted for mounting on a vehicle with a cab and a chassis, the collection body comprising a storage area for storing and compacting refuse, the storage area having a floor structure supporting opposed composite side structures, each side structure comprised of a planar inner wall with an upper edge and a lower edge, a curved outer wall with an upper edge and a lower edge, and a means for joining the inner wall to the outer wall.

2. The refuse collection body of claim 1, wherein the means for joining the inner wall to the outer wall comprises separation means extending a length of the side structure to establish a maximum separation distance between the inner wall and the outer wall.

3. The refuse collection body of claim 2, wherein the separation means is a Z-brace.

4. The refuse collection body of claim 2, wherein the separation means is an I-brace.

5. The refuse collection body of claim 1, wherein the side structure further comprises an upper framing member supporting the upper edge of the inner wall and the upper edge of the outer wall.

6. The refuse collection body of claim 1, wherein the side structure further comprises a lower framing member supporting the lower edge of the inner wall and the lower edge of the outer wall.

7. The refuse collection body of claim 6, wherein the lower framing member consists of a beam having a triangular cross section.

8. The refuse collection body of claim 1, wherein the floor structure comprises a centrally positioned channel with floor members laterally extending from the channel.

9. A refuse collection body adapted for mounting on a vehicle with a cab and a chassis, the collection body comprising:

a. a floor structure with a centrally positioned lower surface providing unified support for the collection body;

b. a storage area for storing and compacting refuse, the storage area supported along its extent by the floor structure and having a top, the storage area with opposed composite side structures, each side structure comprising a upper longitudinal framing member and a lower longitudinal framing member, the framing members supporting therebetween a planar inner wall and a curved outer wall, the inner and outer walls being separated by a longitudinal Z-brace;

c. a reception area for receiving refuse, the reception area supported by the floor structure and having opposed linear side partitions coplaner with the inner walls of the composite side structures; and, d. a divider extending downwardly from the top to terminate a distance from the floor structure to define an opening between the storage area and the reception area along the floor structure.

10. The refuse collection body of claim 9, wherein the floor structure is comprised of a longitudinal channel extending the length of the floor structure, the channel sized for fixed placement on the vehicle chassis.

11. The refuse collection body of claim 9, the further comprising:

a. the collection body with a rear end in direct communication with the storage area; and, b. a tailgate pivotally connected to the collection body to provide closure for the rear end, the tailgate movable between a closed position covering the rear end providing containment for refuse in the storage area and an open position uncovering the rear end allowing emptying of refuse from the storage area.

12. The refuse collection body of claim 11, the further comprising:

a. the collection area with a front wall in direct communication with the reception area; and, b. a packer disposed for reciprocating movement between a first position proximate to the front wall and a second position proximate to the rear end along the floor structure through the opening, the reciprocating movement provided by a packer piston fixedly attached to the front wall, the packer capable of moving refuse deposited in the reception area to the storage area and providing compressive force to the refuse to reduce its volume.

13. The refuse collection body of claim 12, wherein the packer is supported by a plurality of sliding bearings received by the channel in the floor structure for guided reciprocating movement.

14. The refuse collection body of claim 13, wherein the sliding bearings are composed of polyethylene.

15. The refuse collection body of claim 12, the further comprising:

a. a means for loading refuse contained in a curbside container into the reception area, the loading capable of optionally being performed while the refuse is being compressed.

16. The refuse collection body of claim 12, the further comprising:

a. a multi-paneled cover mounted within the collection body and extending between the inner side walls and panels generally parallel to the floor structure, the cover having a first end connected to the packer and a second end, the cover guided by a track along the inner walls, the partitions, the front wall, and partially over the cab, the cover having a length sufficient to cover the packer piston when the packer is in a position proximate the divider.

17. The refuse collection body of claim 12, wherein the position of the packer is sensed by means of a solid state detection device.

18. The refuse collection body of claim 17, wherein the solid state detection device comprises a retroflective infrared sensor.

19. A refuse collection apparatus adapted for mounting on a vehicle with a cab and a chassis, the apparatus comprising:

a. a collection body mounted to the chassis; the collection body having a front wall, a rear end, and a floor, the collection body with a reception area bounded by the front wall and a storage area; the storage area having a top and opposed side structures; each side structure comprised of a planar inner wall, a curved outer wall, and a means for joining the inner wall to the outer wall; the reception area having opposed side partitions which are coplanar with the corresponding inner walls; a divider extending downwardly from the top to terminate a distance from the floor to define an opening between the storage area and the reception area along the floor;

b. a tailgate connected to the collection body to provide closure for the rear end, the tailgate movable between a closed position covering the rear end providing containment for refuse in the storage area and an open position uncovering the rear end allowing emptying of refuse from the storage area;

c. a packer disposed for reciprocating movement between a first position proximate to the front wall and a second position proximate to the rear end along the floor through the opening, the reciprocating movement provided by a packer piston fixedly attached to the front wall, the packer capable of moving refuse deposited in the reception area to the storage area and providing compressive force to the refuse to reduce its volume;

d. a means for loading refuse contained in a curbside container into the reception area, the loading capable of optionally being performed while the refuse is being compressed; and, e. a multi-paneled cover mounted within the collection body and extending between the sides generally parallel to the floor to prevent refuse from contacting the packer piston, the cover having a first end connected to the packer and a second end, the cover guided by a track along the inner walls, the partitions, the front wall, and partially over the cab, the cover having a length sufficient to cover the packer piston when the packer is in a position proximate the divider.

20. The apparatus of claim 19, wherein the collection body is fixedly mounted to the chassis so that the collection body rotates around a horizontal axis relatively near the rear end in response to a lifting mechanism applying upward force to point relatively near the front wall, whereby the collection body is tilted for unloading its contents by gravity.

21. The apparatus of claim 19, further comprising a hydraulic actuating system having a fixed displacement hydraulic pump, a hydraulic fluid reservoir, a plurality of solenoid operated hydraulic valves, and a plurality of packer valves, the packer piston articulated by fluid from the pump passing through the hydraulic packer valves configured in parallel so that volume of hydraulic fluid received by the packer piston is divided between the packer valves during articulation of the packer piston.

22. The apparatus of claim 19, wherein the position of the packer is sensed by means of a solid state detection device.

23. The apparatus of claim 22, wherein the solid state detection device comprises a retroflective infrared sensor.

* * * * *